US006964715B2

(12) United States Patent
Baglini et al.

(10) Patent No.: US 6,964,715 B2
(45) Date of Patent: Nov. 15, 2005

(54) HIGH IMPETUS, HIGH BURN RATE GAS GENERANT PROPELLANT AND SEATBELT PRETENSIONER INCORPORATING SAME

(75) Inventors: James L. Baglini, Phoenix, AZ (US); Abdel K. Helmy, Moorpark, CA (US); Peter L. Stang, Centennial, CO (US); Dennis E. Dunkerson, Buckeye, AZ (US); James H. Wright, Mesa, AZ (US)

(73) Assignee: Special Devices, Inc., Moorpark, CA (US)

( * ) Notice: Subject to any disclaimer, the term of this patent is extended or adjusted under 35 U.S.C. 154(b) by 0 days.

(21) Appl. No.: 10/389,330

(22) Filed: Mar. 13, 2003

(65) Prior Publication Data

US 2005/0199324 A1 Sep. 15, 2005

(51) Int. Cl.[7] ..... C06B 45/08; F42B 4/10
(52) U.S. Cl. ..... 149/19.92; 149/20; 102/351
(58) Field of Search ..... 149/19.1, 19.2, 149/19.92; 102/351

(56) References Cited

U.S. PATENT DOCUMENTS 3,957,551 A * 5/1976 Filter et al. ..... 149/19.5
5,686,691 A * 11/1997 Hamilton et al. ..... 102/202.5
5,883,330 A 3/1999 Yoshida ..... 149/83
5,936,195 A 8/1999 Wheatley ..... 149/19.91
6,019,861 A 2/2000 Canterberry et al. ..... 149/19.1
6,074,502 A 6/2000 Burns et al. ..... 149/36
6,214,138 B1 * 4/2001 Canterberry et al. ..... 149/36
6,361,630 B2 3/2002 Helmy et al. ..... 149/19.4
2003/0015266 A1 1/2003 Wheatley et al. ..... 149/36

FOREIGN PATENT DOCUMENTS

DE 2063586 7/1971

OTHER PUBLICATIONS

"Thermal Decomposition of 5 Amino Tetrazole Propellant" 36th AIAA Joint Propulsion Conference and Exhibit, Huntsville, Alabama.

* cited by examiner

*Primary Examiner*—John R. Hardee
(74) *Attorney, Agent, or Firm*—Law Offices of Thomas J. Brindisi

(57) ABSTRACT

Gas generating compositions having a fuel preferably comprising a mixture of 5-aminotetrazole (5-AT), azodicarbonamide (ADCA), an oxidizer, and a superfine metal powder burn rate enhancer such as nano-aluminum, for use in automotive seatbelt pretensioners and other suitable applications requiring high impetus, high rate of gas generation. Also, methods of making these compositions, and devices incorporating them such as seatbelt pretensioners.

19 Claims, 8 Drawing Sheets

Example 2
925 mg
Pressure (psi)
9000
8000
7000
6000
5000
4000
3000
2000
1000
0
0
2
4
6
8
10
12
14
16
18
20
Time (ms)
-10 mesh
-10/+20 mesh
-20/+35 mesh
-35 mesh Example 4
-25 mesh Example 5
-10/+20 mesh Example 6
-20 mesh Aging @ 107°C
Example 5
-10/+20 mesh, 925 mg
baseline
408 hr
Pressure (psi)
8000
7000
6000
5000
4000
3000
2000
1000
0
Time (ms)
0
2
4
6
8
10
12
14
16
18
20

Aging @ 107°C

Example 6
-10/+20 mesh, 925 mg

HIGH IMPETUS, HIGH BURN RATE GAS GENERANT PROPELLANT AND SEATBELT PRETENSIONER INCORPORATING SAME

BACKGROUND OF THE INVENTION

The present invention is directed generally to gas generating compositions, methods of producing them, and devices incorporating them, and more particularly, to high impetus, high burn rate gas generating compositions for use in automotive seatbelt pretensioners and other suitable applications.

Gas generating compositions used in automobile safety restraint systems must satisfy several important propellant criteria. These applications require compositions that generate gas with very high mass flow rates, have high thermal stability, and result in combustion products that do not contain excessively harmful gases or excessive solid particulates. An increasing focus on reduction of the toxicity of propellants and their combustion products has resulted in the progressive replacement of azide-based propellants (which were previously the standard airbag gas generants) with pyrotechnic-based formulations, which possess lower toxicity and better performance.

Pyrotechnic gas generant compositions are usually composed of a heterogeneous blend of one or more discrete fuel sources, such as hydrocarbons, tetrazoles, nitramines, guanidines, dicyandiamide, and other NHO containing compounds, which are mixed with one or more oxidizers, such as metal oxides, nitrates, and perchlorates, in varying quantities to produce a desired gas output with relatively benign combustion products, specifically $N_2$, $H_2O$, and $CO_2$. Such compositions may also include burn rate catalysts to enhance the burn rate, binders for improved mechanical properties, and processing aids for easier processability.

Airbags, pretensioners, and similar applications generally mandate non-toxic combustion products, high thermal stability and durability, and a compact and economical overall assembly. The design criteria pertaining to applications such as seatbelt pretensioners, however, differ in some respects from those pertaining to airbags. The primary requirements for the propellant in a pretensioner are high impetus, and a high burn rate with low pressure exponent. Because the pretensioner's piston must be actuated very quickly (generally in less than seven milliseconds) and efficiently, the gas generant must produce a high energy output that tends to require a higher combustion temperature. While it is generally desirable to reduce combustion temperature in airbag applications, this is not a significant constraint in applications such as seatbelt pretensioners because the resulting combustion products are largely contained within the pretensioner's housing rather than being significantly expelled into the environment aspirated by the vehicle occupant, and because a large amount of the heat produced by the burning of the gas generant in a seatbelt pretensioner is converted into kinetic energy in actuating the pretensioner.

Single-base propellant has been a standard propellant in pretensioner gas generant compositions, however, it is associated with the drawbacks of lower thermal stability and high carbon monoxide combustion products. Consequently, there is a need for improved gas generant compositions for use in applications such as pretensioners.

In the context of automotive airbags, it has been known to use 5-aminotetrazole (5-AT) as a high energy clean-burning propellant ingredient, and also in conjunction with iron oxide as a combustion catalyst and a slag forming agent. A. Helmy and W. Tong, *Thermal Decomposition of 5 Amino Tetrazole Propellant,* 36*th AIAA/ASME/SAE/ASEE Joint Propulsion Conference and Exhibit*, AIAA Publication No. 2000-3330, incorporated herein by reference.

U.S. Pat. No. 5,883,330 to Yoshida discloses a gas generant composition consisting essentially of azodicarbonamide (ADCA), an oxidizer, and a burning catalyst preferably in an amount of 0.2 to 10 wt. %.

U.S. Pat. No. 6,019,861 discloses a gas generating composition with a fuel in an amount of 15–30 wt. % and comprising 5-AT possibly with an addition of ADCA or ammonium oxalate, phase-stabilized ammonium nitrate (PSAN) oxidizer in an amount of 35–80 wt. %, and silicon powder having a particle size of 2–100 microns preferably in an amount of 0.5–7 wt. % and for an allegedly critical but unspecified purpose.

U.S. Pat. No. 6,074,502 to Burns et al. discloses a gas generant composition with a primary fuel such as 5-AT preferably in an amount of 9–27 wt. %, a secondary fuel in an amount of 1–15 wt. % and comprising ADCA or hydrazodicarbonamide, PSAN oxidizer in an amount of 55–85 wt. %, and an optional burn rate modifier in an amount of 0–10 wt. % and selected from a variety of possibilities including alkali metals.

U.S. Pat. No. 6,361,630 also discloses the use of a non-azide nitrogen containing organic fuel such as 5-AT or ADCA preferably in an amount of 15 to 35 wt. %, an inorganic salt oxidizer, a metal organic coolant, and optionally a burn rate modifier such as iron oxide in an amount of 1 wt. % in the illustrative examples.

U.S. Patent App. Pub. No. 2003/0015266 to Wheatley et al. discloses the preferred use of an azodiformamidine dinitrate fuel, a co-melt of silver nitrate and potassium nitrate, an auxiliary fuel such as 5-aminotetrazole nitrate, and "a powdered metal or metal oxide as a combustion catalyst to speed the decomposition reaction and also as a combustion aid to facilitate the ignition of the primary propellant or gas generant," which metal or metal oxide powder includes "those based on iron, aluminum, copper, boron, magnesium, manganese, silica, titanium, cobalt, zirconium, hafnium, and tungsten," with a particularly preferred example given as NANOCAT® superfine iron oxide material preferably having an average particle size of 2 nm, a specific surface density of about 250 $m^2g$ and a bulk density of 2 to about 5 wt. %. Wheatley also discloses an optional ignition accelerator/augmenter/enhancer in the form of a graphite powder preferably having an average particle size of 40 microns and in an amount of 0.5 wt. % to 1.5 wt. %.

Finally, nano-aluminum has been known as a burn rate enhancer for propellants (typically double-base propellants) used in high pressure rockets. E.g., M. M. Mench, C. L. Yeh, and K. K. Kuo, Propellant burning rate enhancement and thermal behavior of ultra-fine aluminum powders (Alex), *Proceedings of the* 29$^{th}$ *International Annual Conference of ICT,* Karlsruhe, Federal Republic of Germany, pp. 30/1 to 30/15 (1998).

However, the burn rate and relatively low impetus of the foregoing references are not well-suited for meeting pretensioner performance requirements. Further, none of the foregoing references discloses a propellant employing a fuel comprising a solid solution of 5-AT, ADCA, and a superfine metal powder such as nano-aluminum.

In general, there continues to be a need in light of the foregoing teachings for a gas generant that has a beneficial combination of high impetus, high burn rate, high gas yield, low pressure exponent, high thermal stability, clean combustion products, and that is inexpensive to manufacture.

Thus, there are continuing needs for gas generating compositions and safety devices produced therefrom that are less costly, more predictable in performance, and more compatible with applications such seatbelt pretensioners.

SUMMARY OF THE INVENTION

The gas generant of the present invention consists essentially of a fuel source comprising 5-AT, ADCA, and superfine metal powder such as nano-aluminum, an oxidizer, and a binder. The fuel source preferably comprises a ternary solid solution of the 5-AT, ADCA, and nano-aluminum powder, and the gas generant preferably includes an inorganic oxidizer such as potassium perchlorate ($KClO_4$), ammonium perchlorate ($NH_4ClO_4$), sodium nitrate ($NaNO_3$), or mixture thereof, or an organic oxidizer such as guanidine nitrate. A binder material is also preferably incorporated in a very low concentration.

The fuel of the present invention makes possible in a high impetus, high burn rate with low pressure exponent, high gas yield, and high thermal stability. The incorporation of this fuel with an oxidizer and a binder makes possible a high mass flow rate, high flame temperature, high specific heat ratio, and high impetus, and a resulting gas generant that is capable of meeting the requirements of seatbelt pretensioners.

DETAILED DESCRIPTION OF PREFERRED EMBODIMENTS

Figure 1:
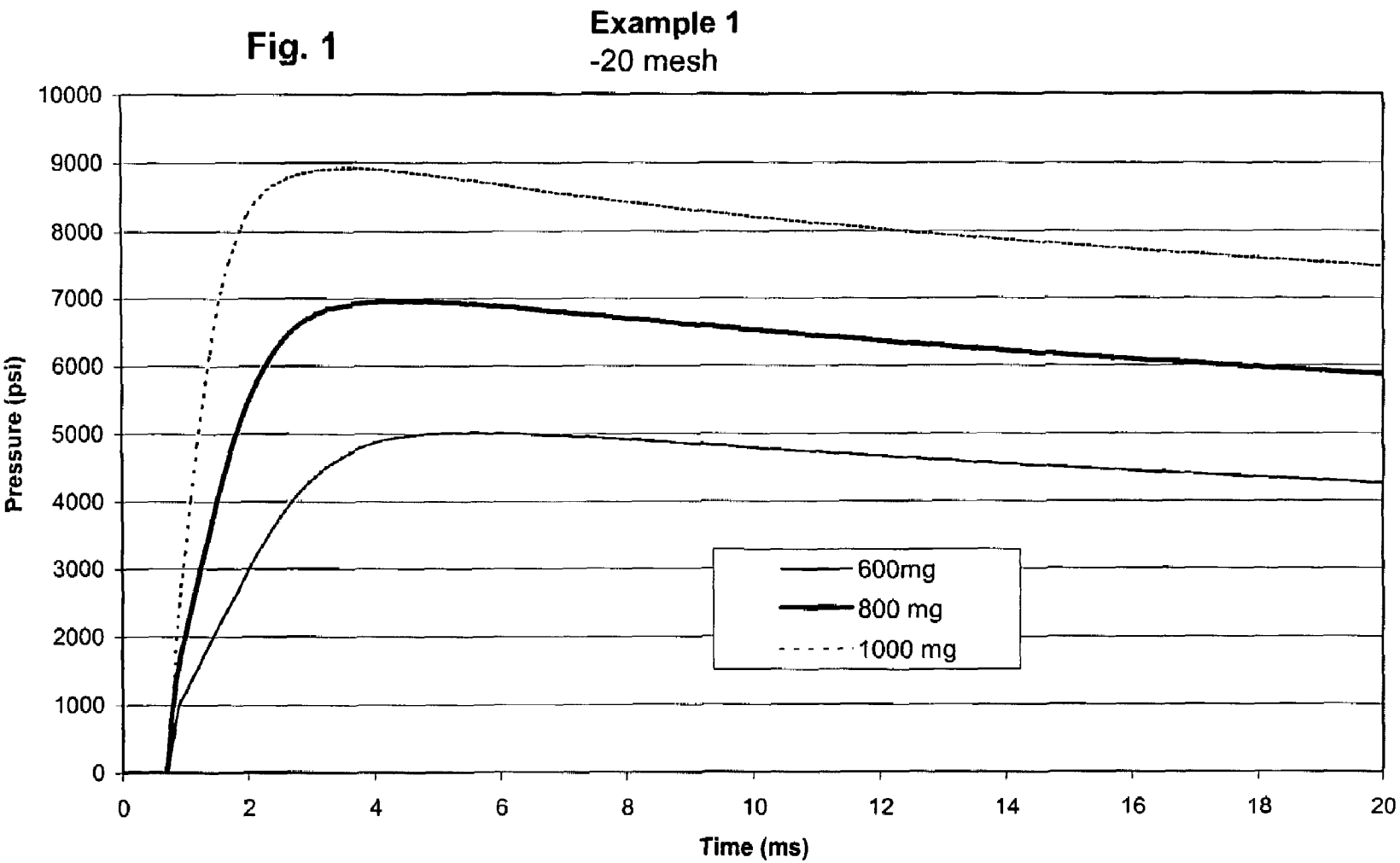
FIG. 1 is a graph of pressure vs. time for an embodiment of the present invention tested in a 10 cc closed-bomb.
Figure 2:
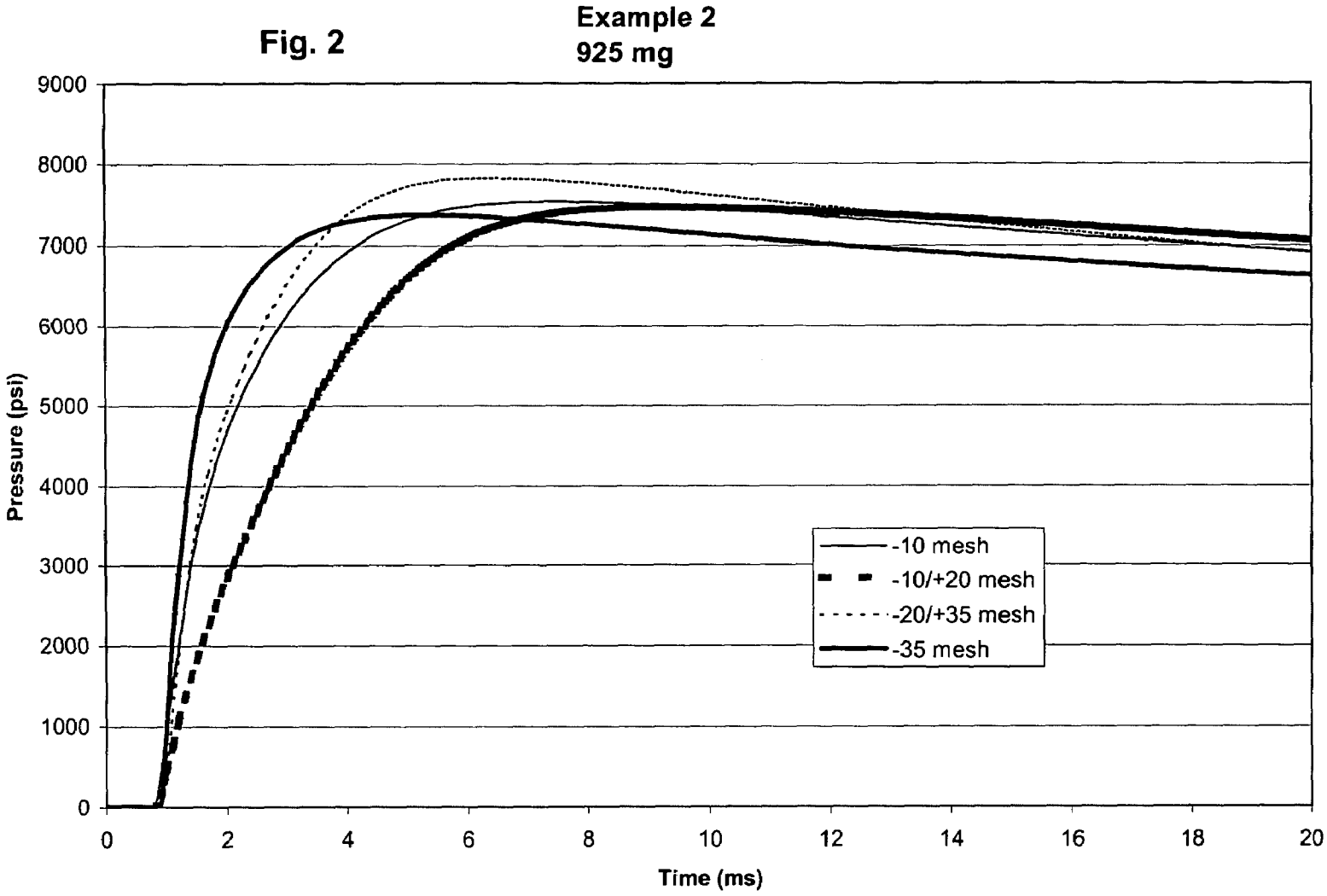
FIGS. 2–6 are graphs of pressure vs. time for other embodiments of the present invention tested in a 10 cc closed-bomb.
Figure 3:
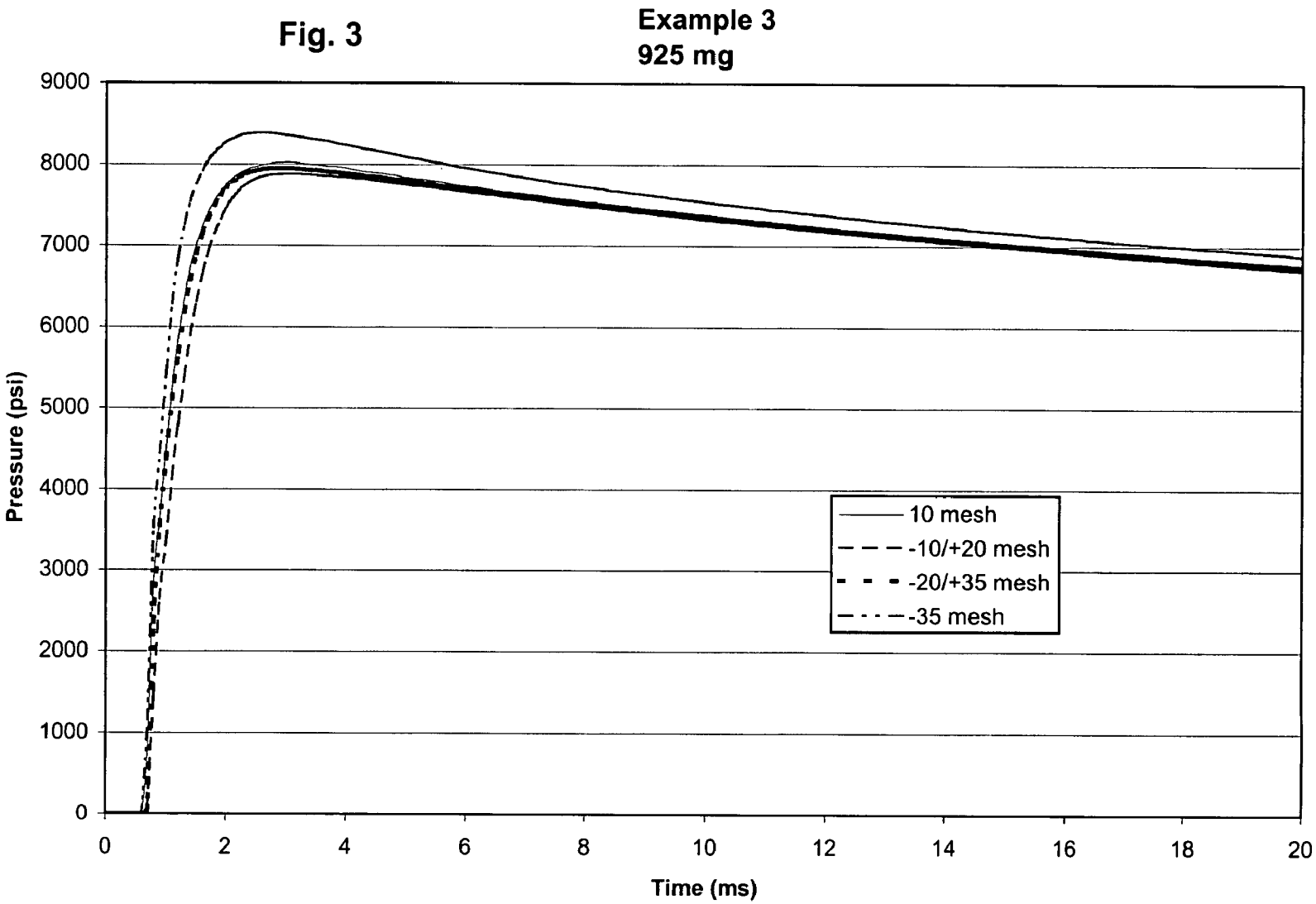
Figure 4:
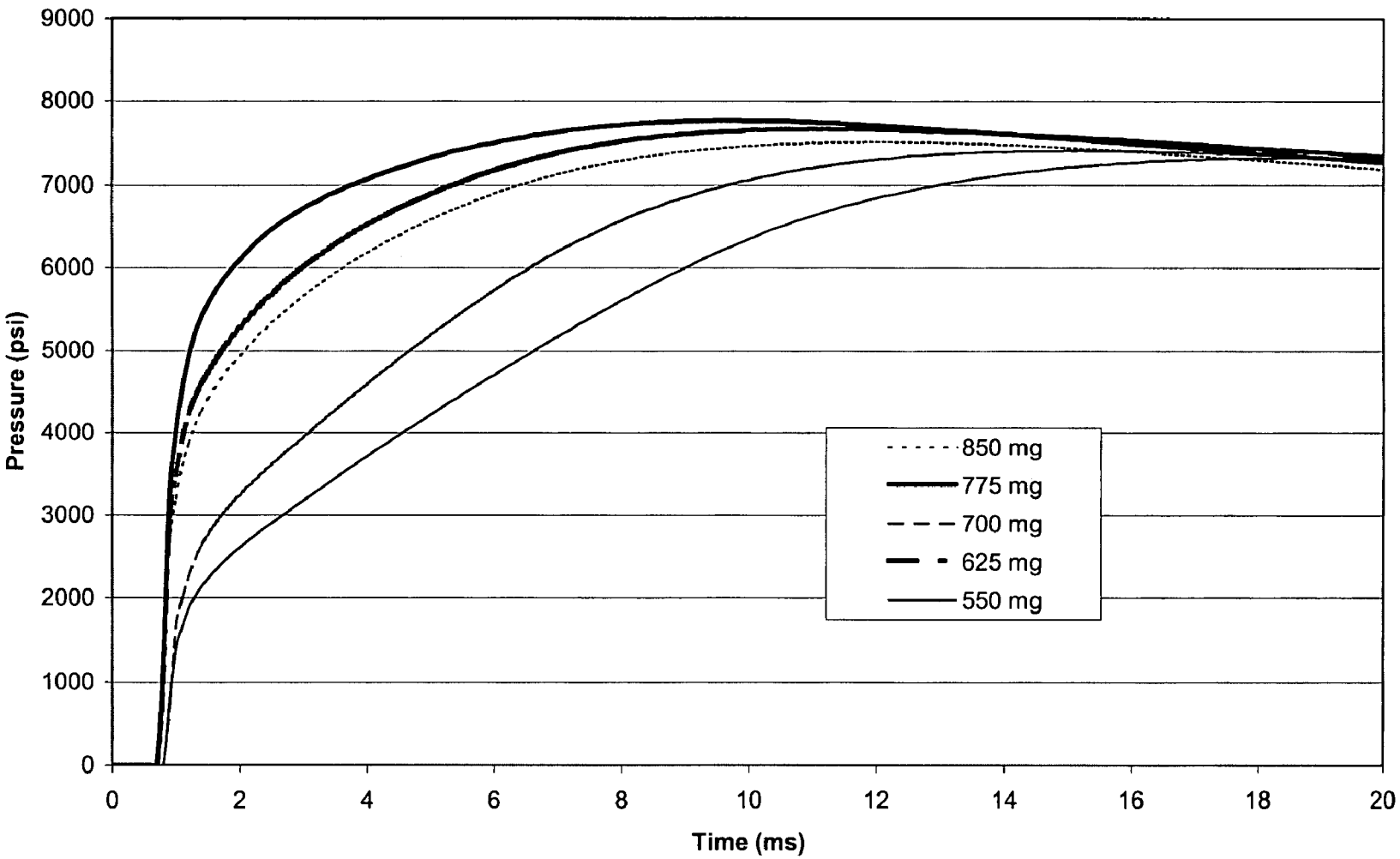
Figure 5:
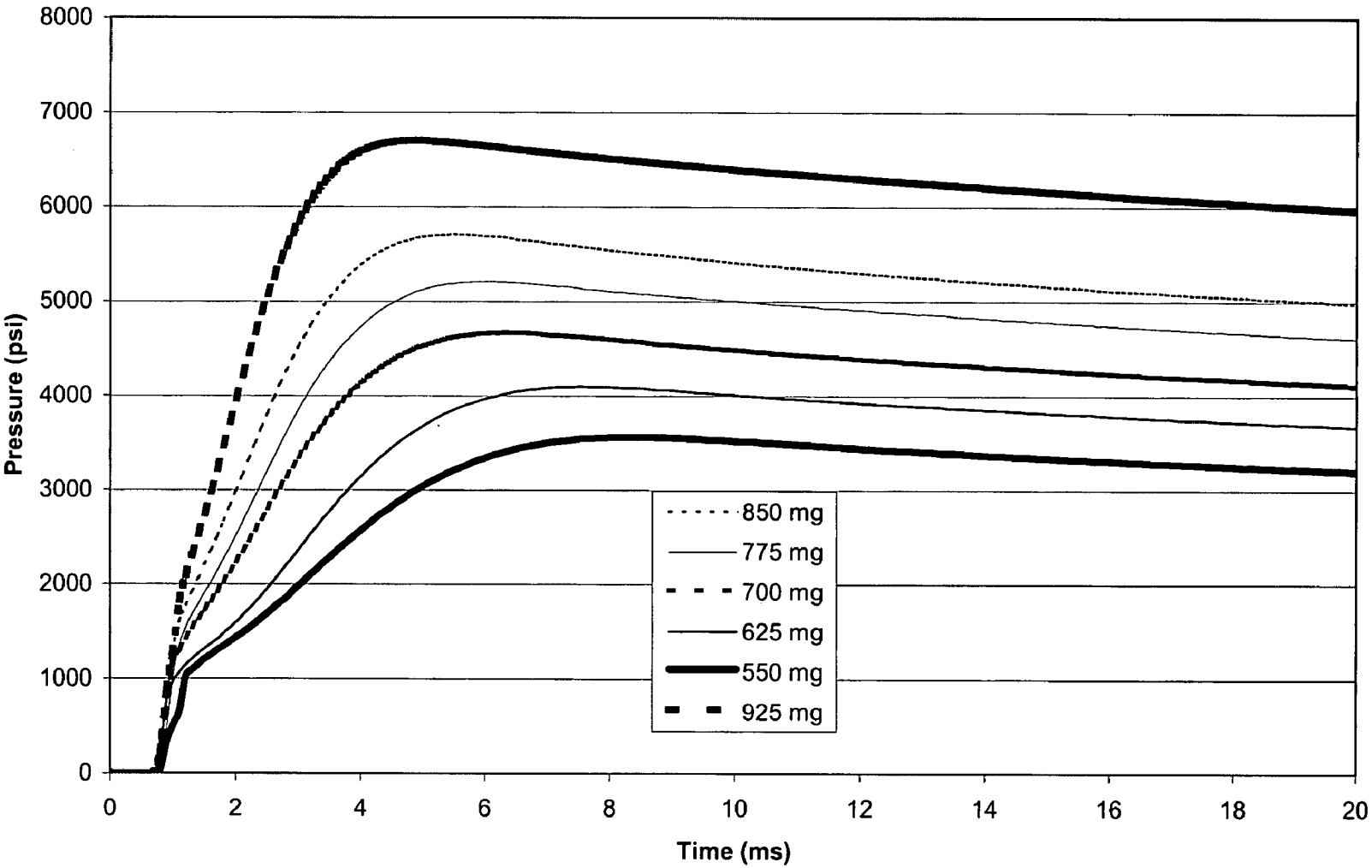
Figure 6:
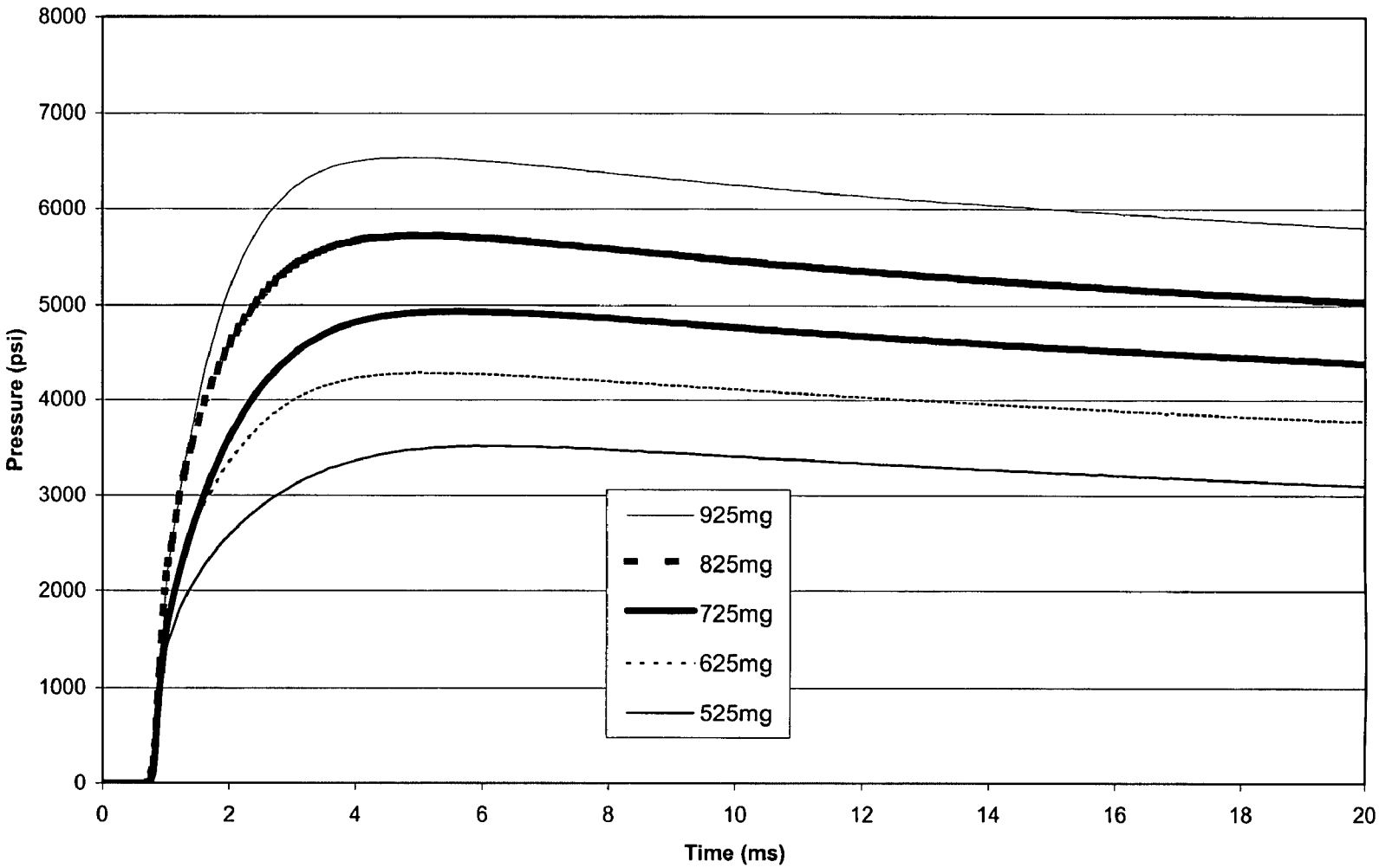

The preferred embodiments of the present invention described herein are designed for use in a seatbelt pretensioner device. The gas generant of the preferred embodiments consists essentially of a fuel source comprising 5-AT, ADCA, and superfine aluminum powder, an oxidizer, and a binder. The fuel source preferably comprises a ternary solid solution of the 5-AT, ADCA, and nano-aluminum powder, and the gas generant preferably includes an inorganic oxidizer such as potassium perchlorate, ammonium perchlorate, sodium nitrate or mixture thereof, or an organic oxidizer such as guanidine nitrate. A binder material (preferably hydrocarbon-based) such as isobutylene rubber, NIPOL® rubber or isoprene rubber is also incorporated in a very low concentration.

The oxidizing agent is not limited specifically and can be selected from those conventionally used in this field. Preferred are those with high oxygen balance, for example, nitrates, oxides, perchlorates, etc. Also, other certain metals of a suitably fine particle size (in the nanometer or micron range) may serve as a suitable flame spread enhancer and burn rate catalyst in place of the aluminum, such as fine boron powder.

The generally acceptable ranges for each important constituent of the present invention are set forth in Table 1, although it will be recognized by one of ordinary skill in the art that further additives may also be included within the scope of the present invention, for purposes such as processing control and other common objectives.

TABLE 1

| Composition Ranges for the Propellant (weight %) | |
|---|---|
| ternary solid solution (TSS) | 10 to 80 |
| oxidizer | 20 to 80 |
| binder | 1 to 10 |
| relative makeup of TSS | |
| azodicarbonamide (ADCA) | 5 to 95 |
| 5-aminotetrazole (5-AT) | 1 to 90 |
| nano-aluminum (nano-Al) | 0.01 to 10 |

It is noted that the 5-AT and ADCA crystals form a solid solution together, which is beneficial since their auto-ignition temperatures are very similar.

Table 2 shows a variety of propellant compositions according to the present invention.

TABLE 2

Composition of the Examples (all values in weight %)

| Example | relative makeup of TSS | | | total | | |
|---|---|---|---|---|---|---|
| No. | 5-AT | ADCA | nano-Al | TSS | oxidizer | binder |
| 1 | 71.4 | 26.2 | 2.4 | 42 | 55 | 3 |
| 2 | 51.4 | 45.9 | 2.7 | 37 | 60 | 3 |
| 3 | 51.4 | 45.9 | 2.7 | 37 | 60 | 3 |
| 4 | 37.0 | 60.0 | 3.0 | 35 | 62 | 3 |
| 5 | 3.0 | 94.0 | 3.0 | 33 | 64 | 3 |
| 6 | 33.4 | 63.3 | 3.3 | 30 | 67 | 3 |

The Examples of Table 2 were prepared as follows. First, a ternary mixture of 5-AT (97% min. purity, from Aldrich Chemical Co. of Milwaukee, Wis.), ADCA (2.0 to 2.4$\mu$ avg. particle size, from Crompton Corp. of Middlebury, Conn.), and nano-aluminum powder (0.09 to 5$\mu$ particle size, available from Technanogy Corp of Irvine, Calif. or Hummel Croton of South Plainfield, N.J.) was prepared by adding the prescribed amount of each component to a carrier solvent (preferably ethyl acetate or acetone), with the nano-aluminum powder preferably being added last, and blending in a high-shear blender for fifteen minutes. The resulting solid solution was then oven-dried and spatulated to a dry powder, although it alternately (and preferably for cost-effective processing) can be used as a slurry in the carrier solvent.

Next, the prescribed amount of rubber binder (NIPOL® AR53L-acrylonitrile <10 ppm, from Zeon Chemicals of Louisville, Ky.) was added to acetone (although any other compatible carrier solvent could be used) in a bottle and rolled on a jar mill until completely dissolved. Then, the prescribed amount of the prepared ternary solid solution was weighed out and added to a two-gallon high-shear mixer. After this, the prescribed amount of dissolved binder was also added to the mixer, which was then operated for five minutes.

Next, the oxidizer for Examples 1–3, 5, and 6 ($KClO_4$, 99% min. purity, from GFS Chemical of Columbus, Ohio) was ground to 7 micron particle size except in Example 2, in which the oxidizer was left un-ground. The oxidizer in Example 4 (50% $NaNO_3$, 99% min. purity, from Columbus Chemical Co. of Columbus, Wis., mixed with 50% $NH_4ClO_4$, 98.5% min. purity, also from GFS Chemical) was also left un-ground. The oxidizer in each Example was then added to the solvent/ternary solid solution/binder mix, and the mixer was operated for an additional twenty minutes. The mixer was then stopped, and the blades and the bowl were scraped down to ensure all of the ingredients are in the mixture. A vacuum was then applied to the mixer while mixing until the mix formed spherical grains (generally ranging from 0.2 to 2 mm in diameter). The propellant mix was then placed in a stainless steel pan in an oven (at about 70° C.) until completely dry, and the resulting dried propellant mix removed from the oven and sieved to classify to different cuts (different particle size ranges).

Many other suitable variations and alternates to the foregoing formulas and processes will be readily apparent to one of skill in the art. For example, it will be appreciated that the ratio of the ternary solid fuel to the oxidizer can be varied to adjust the resulting gaseous output, burn rate, and propellant performance, within the constraints of the applicable pretensioner performance specification. As another example, it will be readily appreciated that the grain geometry of the propellant can be varied to produce desired pressure versus time combustion characteristics tailored to a particular application as is commonly done with solid propellants.

Each of the compositions of Examples 1–6 were subjected to 10 cc closed-bomb testing, the results of which are shown in FIGS. 1–6 (in each of which the pertinent Example No. discussed herein is noted at the top of the Figure). The 10 cc closed-bomb used in these tests was a multi-part cylindrical stainless steel fixture with a fixed volume central perforation bored in the main body, a transducer port in the side of the main body, an "O"-ring groove in both ends of the main body, and a solid base used to close the bottom of the bomb. An adapter specific to the part being tested was placed in the top of the bomb, to hold a specific micro gas generator (MGG) assembled to include the propellant of interest. To perform the tests, the MGG was placed in the adapter and assembled with the bomb, which was then held under pressure in a hydraulic ram until the propellant is fired with an initiator. The resulting data was conveyed from the transducer to a charge amplifier and then to an oscilloscope. From the data reflected in FIGS. 1–6, it was determined that each of the Examples would meet the propellant performance requirements of pretensioner specifications. Specifically, it was determined that the Examples utilizing $KClO_4$ as the oxidizer perform well overall and meet the 3 inch/sec burn rate generally needed to reach the required pretensioner peak pressure. Likewise, it was determined that using the $NH_4ClO_4/NaNO_3$ co-oxidizer in place of $KClO_4$ (as in Example No. 4) also results in a suitable propellant for a pretensioner, and it provides a higher oxygen balance and yields very low toxicity combustion products so as to be suited for applications where a very low toxicity effluent is required. On the other hand, this oxidizer is preferably employed in a propellant that is hermetically sealed, while $KClO_4$ is less sensitive to the environment and has been found suitable for use in non-hermetic (crimped) MGGs.

Figure 7:
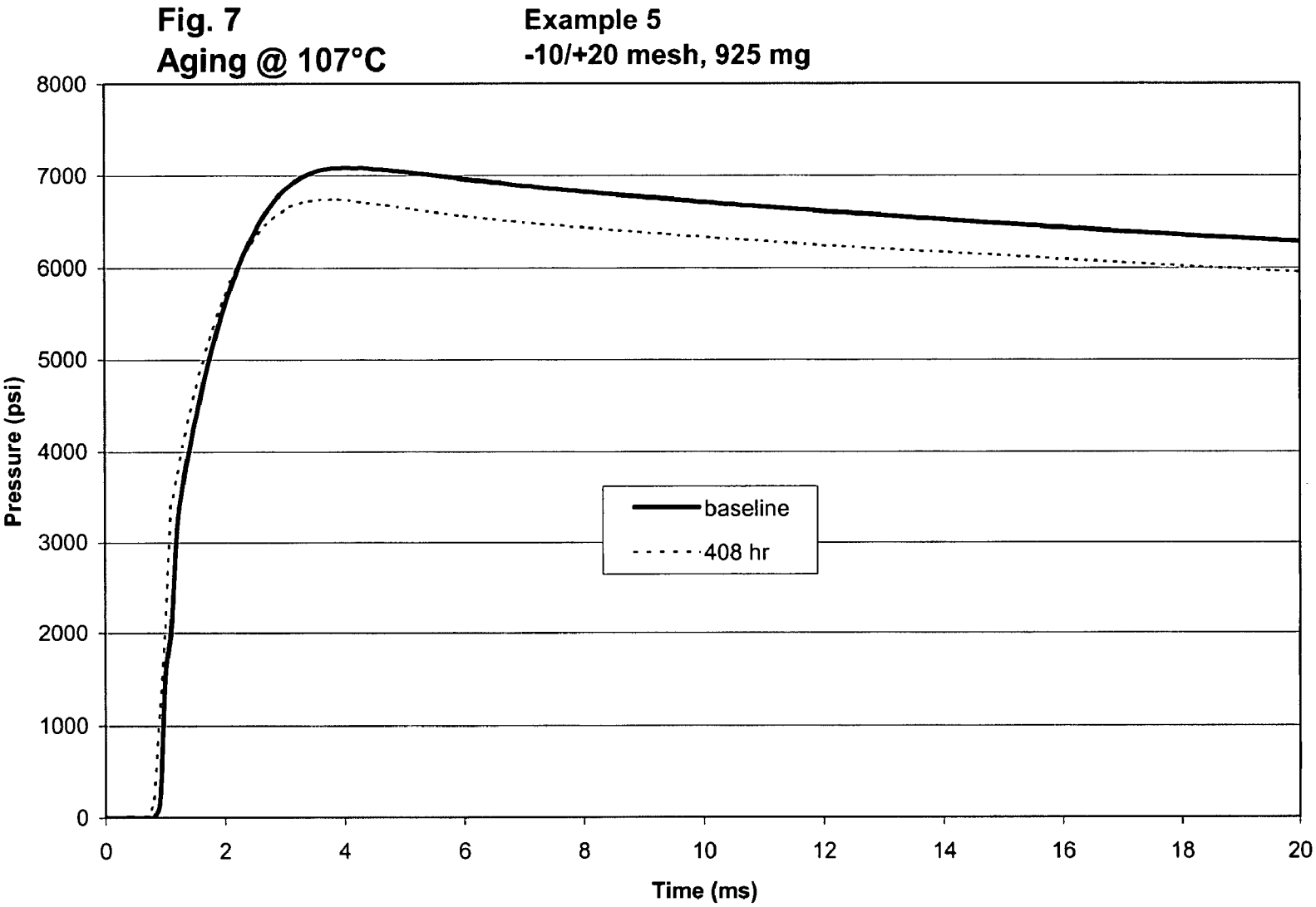
FIGS. 7 and 8 are graphs of pressure vs. time for two embodiments of the present invention subjected to 10 cc closed-bomb testing at 0 hours and 408 hours aging.
Figure 8:
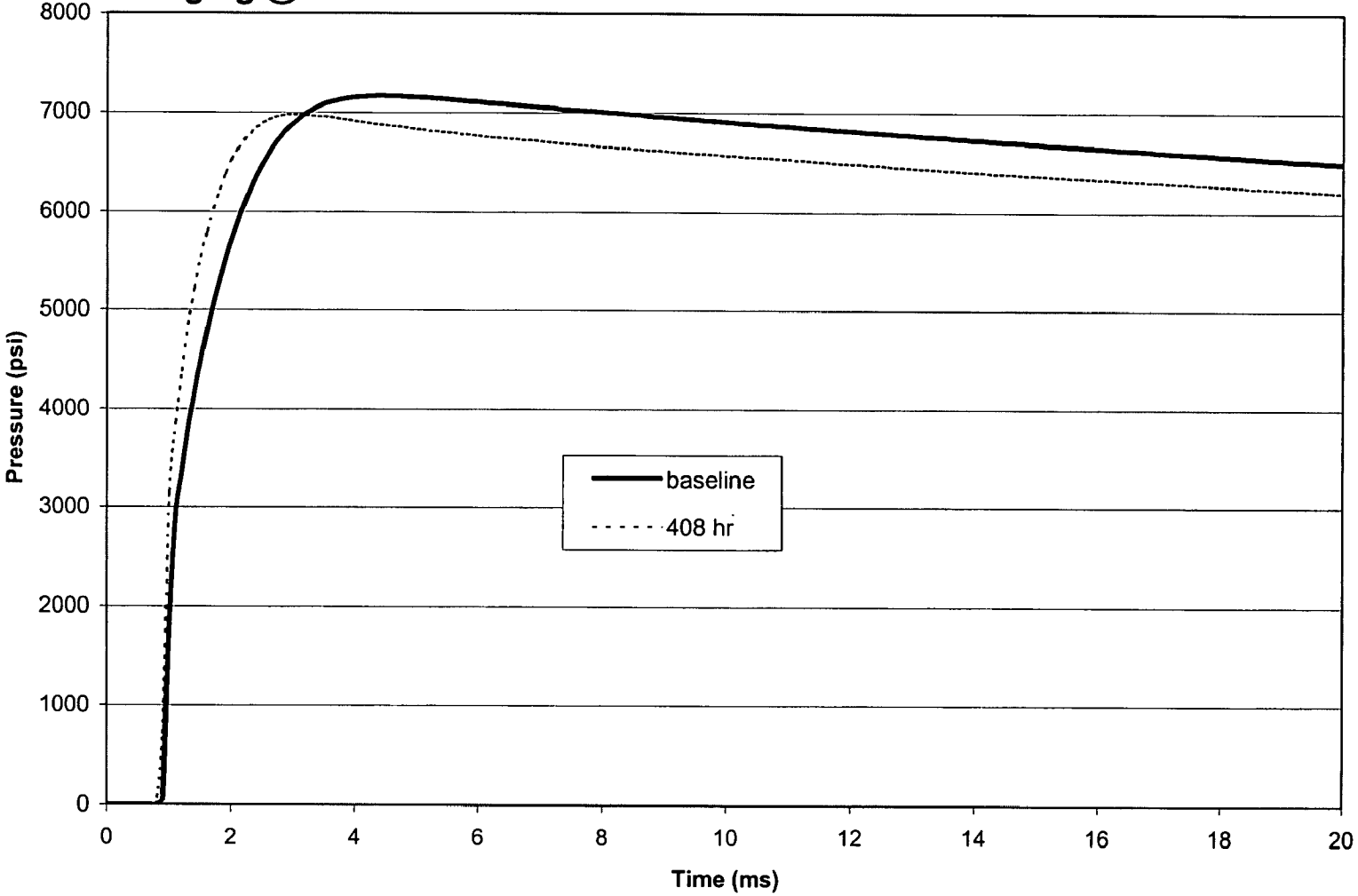

Although ADCA and 5-AT have been associated with thermal decomposition problems (see A. Helmy and W. Tong, "Thermal Decomposition of 5 Amino Tetrazole Propellant" 36th AIAA/ASME/SAE/ASEE Joint Propulsion Conference and Exhibit, AIAA Publication No. 2000-3330; and U.S. Pat. No. 6,475,312 to Burns et al.), the above Examples of the present invention were tested and found to exhibit high thermal stability. The compositions do not decompose when subjected to temperatures of 107° C. for periods of up to 408 hours, and did not show any performance loss or weight loss after such exposure. In this regard, FIG. 7 illustrates the performance at 0 hours and at 408 hours for the gas generant of Example 5. Other examples were similarly tested and found to exhibit very similar aging performance, such as that shown for Example 6 in FIG. 8. For the aging study, a number of parts were tested in the 10 cc bomb apparatus described above to obtain a baseline determination, and other units were put into an environmental chamber at 107° C., with a number of units then being removed and test-fired every three days until the final units had completed 408 hours at 107° C.

The impetus, flame temperatures, gas output, and specific heat ratios were calculated for each of the Examples using the Propellant Evaluation Code (PEP) authored by the US Naval Weapon Center, Indian Head. Impetus was also assessed through calculations based on the pressure-time results derived from the 10 cc closed-bomb testing.

TABLE 3

Thermochemical Characteristics of the Examples

| Example No. | impetus (J/gm) | flame temp. (K) | gas output (moles/100 gm) | specific heat ratio |
|---|---|---|---|---|
| 1 | 850 | 2848 | 3.0 | 1.22 |
| 2 | 774 | 2977 | 2.7 | 1.20 |
| 3 | 774 | 2977 | 2.7 | 1.20 |
| 4 | 798 | 2458 | 3.0 | 1.19 |
| 5 | 628 | 2620 | 2.5 | 1.19 |
| 6 | 652 | 2697 | 2.5 | 1.16 |

Through these and other calculations and tests, it was determined that the relative makeup of the ternary solid solution of Example 1 provides the highest possible impetus, however, Examples 2 and 3 are advantageous in that they provide very high burn rate (3 m sec to peak pressure).

It was also determined that the ternary solid solution must include at least about 1 wt. % of 5-AT in order to have sufficient energy for use in a seatbelt pretensioner. As can be seen from Table 3, Example 5, in which the ternary solid includes only 3 wt. % of 5-AT, results in 628 J/g impetus. Yet if the 5-AT is eliminated completely, the resulting impetus is only about 500 J/g. On the other hand, the amount of 5-AT that can be included is limited by the combustion stoichiometry and its effect on the propellant energy output. It was determined that if the amount of ADCA is decreased too far (below about 5 wt. % of the ternary solid), the impetus produced dramatically decreases due to the reduction in the resulting amount of gas created.

The nano-aluminum in the Examples serves as a burn rate catalyst, flame propagation enhancer and flame temperature improver. In this regard, it was determined that if the amount of nano-aluminum is decreased too far (below about 0.01 wt. % of the ternary solid), the flame spreading and burn rate are disadvantageously reduced.

Although the 5-AT used in the present invention has been described in its anhydrous form, it will be understood that the teachings herein encompass the hydrated forms as well. Further, one skilled in the art will appreciate that certain other variants might be substituted for the 5-AT and ADCA of the present invention. For example, it is possible that a suitable related chemical such as ADCA dinitrate, or another suitable blowing agent, could be used in place of the ADCA of the present invention, with appropriate modifications to the formula. Thus, while the foregoing examples illustrate and describe the use of the present invention, they are not intended to limit the invention as disclosed in certain preferred embodiments herein. Variations and modifications commensurate with the above teachings and the skill and/or knowledge of the relevant art are within the scope of the present invention.

What is claimed is:

1. A gas generating composition having:

a. a fuel that is a ternary solid solution and essentially comprises 5-AT, a blowing agent comprising ADCA, and a superfine metal powder burn rate enhancer;

b. an oxidizing agent; and, c. a binder.

2. The composition of claim 1, further comprising an additional processing aid additive.

3. The composition of claim 1, wherein said superfine metal powder has a sub-micron particle size.

4. The composition of claim 3, wherein said superfine metal powder comprises aluminum.

5. The composition of claim 3, wherein said fuel comprises from 10 to 80 wt. % of said composition, said oxidizing agent comprises from 20 to 80 wt. % of said composition, and said binder comprises from 1 to 10 wt. % of said composition, and wherein said fuel is comprised of from 1 to 90 wt. % 5-AT, 5 to 95 wt. % ADCA, and 0.01 to 10 wt % superfine metal powder.

6. The composition of claim 5, wherein said superfine metal powder comprises aluminum and comprises from 1 to 5 wt. % of said fuel.

7. The composition of claim 6, wherein said oxidizing agent essentially comprises one or more chemicals selected from the group consisting of $KClO_4$, $NH_4ClO_4$, and $NaNO_3$.

8. A seatbelt pretensioner including a gas generant composition that includes:

a. a fuel that is a ternary solid solution and essentially includes 5-AT, a blowing agent comprising ADCA, and a superfine metal powder burn rate enhancer;

b. an oxidizing agent; and, c. a binder.

9. The pretensioner of claim 8, wherein said superfine metal powder comprises aluminum.

10. The pretensioner of claim 9, wherein said fuel comprises from 10 to 80 wt. % of said composition, said oxidizing agent comprises from 20 to 80 wt. % of said composition, and said binder comprises from 1 to 10 wt. % of said composition, and wherein said fuel is comprised of from 1 to 90 wt. % 5-AT, 5 to 95 wt. % ADCA, and 1 to 5 wt. % aluminum having a sub-micron particle size.

11. The pretensioner of claim 10, wherein said oxidizing agent essentially comprises $KClO_4$ and said pretensioner includes an igniter that is crimped.

12. The pretensioner of claim 10, wherein said oxidizing agent essentially comprises a mixture of $NH_4ClO_4$ and $NaNO_3$ and said pretensioner includes an igniter that is hermetically sealed.

13. A method of making a gas generating composition comprising the following steps:

a. providing a fuel that is a ternary solid solution and essentially comprises 5-AT, a blowing agent comprising ADCA, and a superfine metal powder burn rate enhancer;

b. providing an oxidizing agent;

c. providing a binder; and, d. mixing said fuel, oxidizing agent, and binder to form said gas generating composition.

14. The method of claim 13, wherein said binder is pre-cured.

15. The method of claim 13, wherein step c) is performed prior to step b).

16. The method of claim 13, wherein said binder is Nipol®, said oxidizing agent is $KClO_4$, and said composition is for use as a propellant in a seatbelt pretensioner having a non-hermetically sealed igniter.

17. The method of claim 13, wherein said method includes the step of applying a vacuum to said ternary solid solution, oxidizing agent, and binder until spherical grains substantially ranging from 0.2 to 2 mm in diameter are formed.

18. The method of claim 17, wherein said ternary solid solution comprises from 10 to 80 wt. % of the resulting composition, said oxidizing agent comprises from 20 to 80 wt. % of the resulting composition, and said binder comprises from 1 to 10 wt. % of the resulting composition, wherein said ternary solid solution is comprised of from 1 to 90 wt. % 5-AT, 5 to 95 wt. % ADCA, and 1 to 5 wt. % aluminum having a sub-micron particle size, wherein said oxidizing agent essentially comprises one or more chemicals selected from the group consisting of $KClO_4$, $NH_4ClO_4$, and $NaNO_3$, and wherein said binder is hydrocarbon-based.

19. The method of claim 13, further comprising the step of preparing said ternary solid solution in a slurry.

* * * * *